US005669427A

United States Patent [19]

Hasper et al.

[11] Patent Number: 5,669,427

[45] Date of Patent: Sep. 23, 1997

[54] VALVE ASSEMBLY FOR USE WITH A BOTTLE OR A CONTAINER

[76] Inventors: Pat K. Hasper; Wolfgang A. Hasper, both of 6060 Miller Landing Cove, Tallahassee, Fla. 32312

[21] Appl. No.: 292,013

[22] Filed: Aug. 18, 1994

Related U.S. Application Data

[63] Continuation-in-part of Ser. No. 216,502, Mar. 23, 1994, Pat. No. 5,402,836.

[51] Int. Cl.[6] ..... B65B 1/04

[52] U.S. Cl. ..... 141/364; 141/348; 141/357

*Primary Examiner*—Henry J. Recla
*Assistant Examiner*—Steven O. Douglas

[57] ABSTRACT

This invention provides for a valve assembly to be releasably attached to the spout of a conventional bottle or container that houses a fluid. The valve assembly includes a cap, a shaft, and a shank. The cap is releasable attached to the spout of the bottle and includes a central aperture. The shank is received within the aperture of the cap. The shank has a hollow tubular configuration and receives the shaft. The configuration and design of the valve assembly permits for the shaft to slide freely within the shank from an open position to a closed position. Additionally the top of the shaft includes a plurality of holes which are exposed when the valve assembly is in an open position. The shank covers the holes thereby providing the valve assembly to be in a closed position.

10 Claims, 9 Drawing Sheets

VALVE ASSEMBLY FOR USE WITH A BOTTLE OR A CONTAINER

This is a continuation-in-part of application Ser. No. 08/216,502 filed Mar. 23, 1994, now U.S. Pat. No. 5,402, 836.

BACKGROUND OF THE INVENTION

1. Field of the Invention

The present invention relates to a valve assembly and more particularly to a valve assembly that can be attached to a bottle or container to enable an effortless transfer of fluid from the bottle or container to a desired location without spilling or wasting the fluid during the transfer.

2. Description of the Prior Art

The transferring of a fluid from a bottle or a container is a task that is done daily and at times can be tedious and frustrating. A mechanic who is constantly removing and replacing oil in the oil pan of a vehicle finds it difficult to invert and align the oil bottle onto the oil reservoir without spilling the oil. A homeowner who periodically fills the lawnmower with gasoline finds it difficult to align the gas tank with the spout of a gasoline container, since the spout is extremely short and is normally larger than the opening of the gas tank. These, and other similar routine chores tend to become time consuming, sloppy, dirty, and annoying due to the difficulties of trying to invert a container or bottle without spilling the fluid.

Because of the above-identified problems, various valves have been developed for simplifying the transfer of a fluid within a bottle or a container. Such a device is disclosed in, for example, U.S. Pat. No. 4,903,742 issued to Gagnon on Feb. 27, 1990. The valve disclosed in the Gagnon patent consists of a plunger which can move linearly within a valve housing. The plunger includes two segments that are parallel to each other and that have an actuation head therebetween. Thereby, when force and pressure is applied to the actuation end, the plunger moves linearly to an opened position. A disadvantage to this system is the shape and structure of the plunger. The actuation head is centrally located from the valve housing. This arrangement causes an obstruction in the path of the fluid flow. Additionally, this valve assembly actuation means requires a force or pressure to be applied at the actuation end. In order to use this valve assembly the end must contact a surface. Thus, the utilization of Gagnons valve assembly in the above-identified situation would require an adjustment to the length of the segments. This lengthening would be pointless since there is no universal length or height for any particular container or reservoir (i.e. oil reservoir, power steering reservoir, windshield cleaning fluid reservoir, coolant reservoir, gasoline tank, etc.).

SUMMARY OF THE INVENTION

The present invention provides for a valve assembly that can be used with any type of bottle or container that dispenses a fluid. The valve assembly to the present invention includes several embodiments that all consists of a cap, shank, and shaft.

In each of the embodiments, the cap is releasably attached to the spout of the bottle. The cap includes a top and an encompassing side wall which, combined, provides a secure and snug fit when attached to the spout of a bottle or a container. The cap can be threaded to enable it to be secured to the threaded spout of bottle or container. Further, the cap can include a break-off or tear-off seal-like means for indicating if the bottle has been tampered with prior to its first use by an individual. Additionally, centrally located on the cap is an aperture. This aperture receives the shank.

The shank is a hollow tube and is designed to receive the shaft. The shank includes a first end and second end. At least one of the first or second ends of the shank is opened. This opened end of the shank receives the shaft. The shaft can move axially within the shaft by providing the valve assembly to have an opened position and a closed position. In another embodiment, the shaft can freely rotate circumferencially within the shank from an open position to a closed position. In this configuration, the rotation works together with a pin on the shank and a channel located on the shaft to align or disalign holes which are located on the shank and shaft in order to provide for the valve assembly to be n an opened or closed position.

The shaft includes an opened end and an enclosed end. In one embodiment, a plurality of holes are located on the encompassing side wall near the enclosed end of the shaft. The shank covers or blocks the holes when the valve assembly is in a closed position. When the holes are exposed, the valve assembly is in an open position. In another embodiment, the holes are located in the shank. The shaft covers or blocks the holes in a closed position while in an opened position the holes are exposed. Once these holes, located in the shaft or shank, are exposed (open position), the fluid is able to flow from the bottle.

The plurality of embodiments for the valve assembly of the present invention is also provided with a means to visually indicate whether or not the valve assembly has been tamper with prior to its first use by an individual. This means can include, but is not limited to, a removable, but not reusable seal. This seal is located on the opening of the shaft. Another means is to provide for a tamper proof, tamper resistance, and tamper evidence lid which covers and secures the valve assembly. The lid can further include a shrink wrap (seal) with a breakable seam for securing around the lid and optionally around the bottle.

Accordingly, it is an object of the present invention to provide for a valve assembly that will eliminate the difficulties, such as spillage of pouring a fluid from a container to a desired location.

Another object of the present invention is to provide a means for indicating whether or not the valve assembly has been tampered with prior to its first use by an individual.

Yet another object of the present invention is to provide for a valve assembly that can be reusable.

Still another object of the present invention is to provide for a valve assembly that is durable in operation and inexpensive to fabricate.

Other objects, features and advantages of the present invention will become apparent of those skilled in the art form the following detailed description. It should be understood, however, that the detailed description and specific examples while indicating preferred embodiments of the present invention, are given by way of illustration and not limitation. Many changes and modifications within the scope of the invention may be made without departing from the spirit thereof, and the invention includes all such modifications.

BRIEF DESCRIPTION OF THE DRAWINGS

Similar reference numerals refer to similar parts throughout the several view of the drawings.

DESCRIPTION OF THE PREFERRED EMBODIMENTS

Figure 1A:
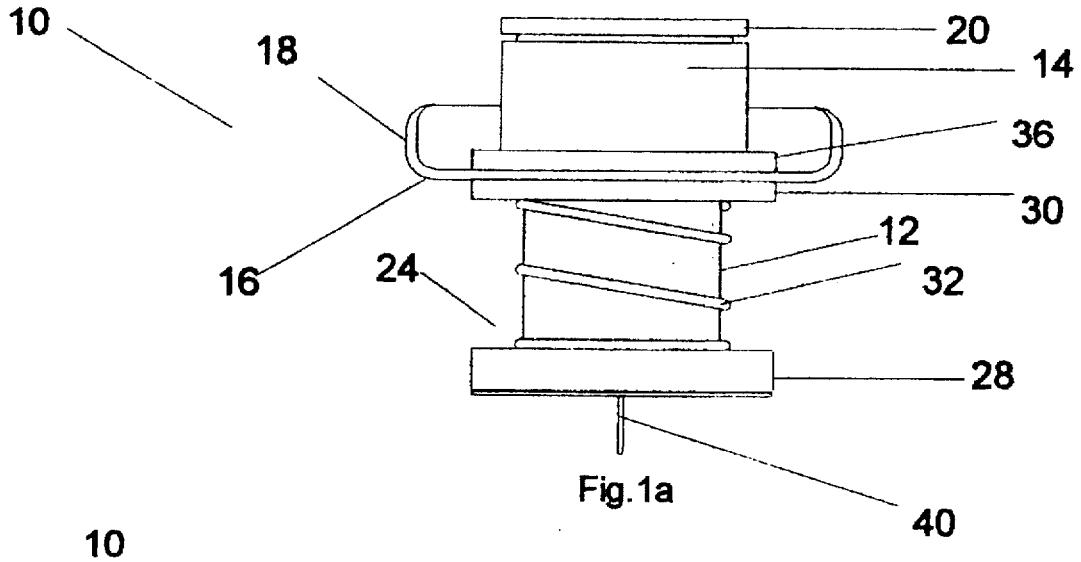
FIG. 1*a* is a side elevational view of an embodiment of the valve assembly of the present invention in a closed position.
Figure 1B:
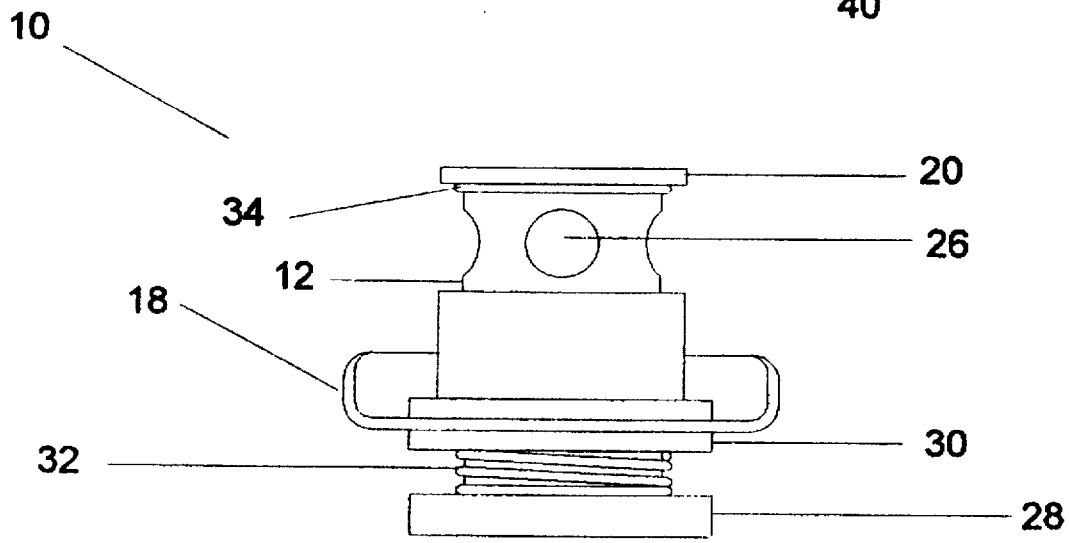
FIG. 1*b* is a side elevational view of the valve assembly of the present invention in an opened position.
Figure 2:
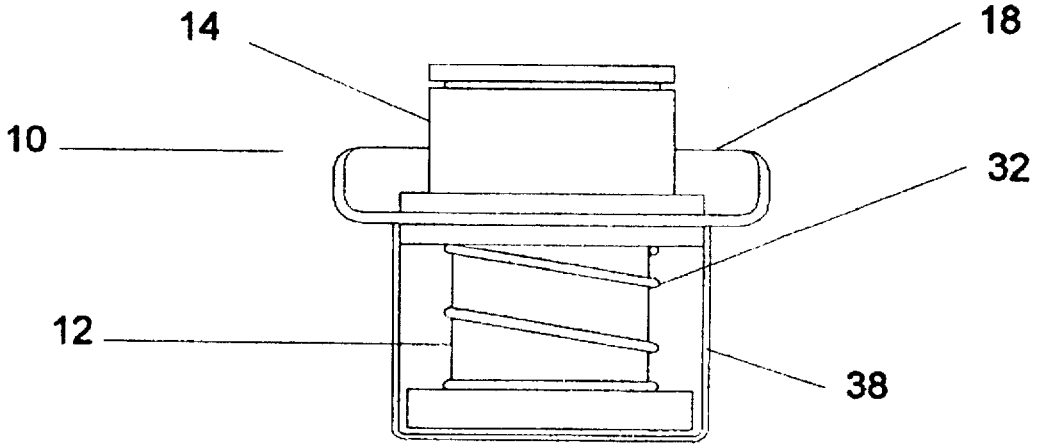
FIG. 2 is a side elevational view of the valve assembly of the present invention further including a lid.

FIGS. 1*a*–2 illustrate the various views of the first embodiment of the valve assembly of the present invention. As seen in these figures, the valve assembly 10 consists of a shaft 12, shank 14, and cap 16. As these figures illustrate, the cap 16 is adapted to be releasably secured to a bottle (not illustrated).

As seen, the cap 16 consists of a top and an encompassing side wall. Located on the top of the side wall is an inwardly curved peripheral end portion 18. This end portion and the side wall of the cap provide for a snug, secured, and releasably attachable fit on the spout of a bottle or container (not illustrated).

Centrally located on the top of the cap is an aperture (not illustrated). This aperture receives the shank 14. The top, encompassing side wall, and inwardly curved peripheral end portion of the cap form an integral object which can be made out of any durable and resilient material, such as rubber or plastic.

The shaft 12 is an elongated cylindrical hollow tube having an enclosed end and an opened end. The enclosed end extends outwardly form the shaft to form a first flange 20. This first flange 20 acts as a stopping mechanism for the shank 14. This shaft further includes a first area 22 and a second area 24. Encompassing the first area of the shaft is a plurality of holes 26. These holes allow the fluid to flow from the container or bottle once the valve assembly is in an opened position. Attached to the second area of the shaft is a second flange 28. The first and second flanges are integral with the shaft and can be constructed from any durable and sturdy material, such as polyvinyl chloride (PVC).

The shank 14 is a hollow tube which has an opened first end and an opened second end. The shaft 12 is received in the opened first end. Extending from the second end of the shank is a third flange 30. The shank is an integral object and can be fabricated from any durable and sturdy material, such as polyvinyl chloride (PVC).

A spring 32 is located on the shaft an is in communication with the second flange 28 of the shaft 14 and the third flange 30 of the shank. When the spring is in an unbiased state, the valve assembly is in a closed state (see FIG. 1*a*).

The shaft moves linearly when it is pressurized (i.e. the valve is attached to a bottle that houses oil and it is inverted into the opening of an oil pan, the contact of the oil pan to the valve causes the pressurization). The pressurization causes the spring to compress in a bias status as well as provides for the plurality of holes to be exposed. This establishes for the fluid within the container to flow from the valve assembly (see FIG. 1*b*).

When the pressure is relieved (i.e. removing the bottle from the opening in the oil pan), the status of the spring is reversed. That is, the spring returns to an extended, normally closed status. The shaft also returns linearly to its normally closed position (holes are not exposed as illustrated in FIG. 1*a*) and disconnects the fluid flow communication between the container and valve.

A first O-ring or washer 34 is located under and is in contact with the first flange on the shaft and a second O-ring or washer 36 is located on and above the third flange of the shank. This second O-ring or washer is in direct communication with the interior of the top surface of the cap. These O-rings or washers provide an adequate sealing means and also restrict the flow of fluid from leaking out of the vale assembly.

A lid 38 may be placed on the valve assembly when it is in a closed position (see FIG. 2). This lid will protect the valve assembly and will maintain obstruction to the spring. Accordingly, protecting the spring from any unnecessary pressure.

A non-reusable seal 40 may be attached to the opened second end of the shaft. This seal will be used as an indication to verify or confirm if any tampering had been done to the valve assembly prior to its first use.

Figure 3A:
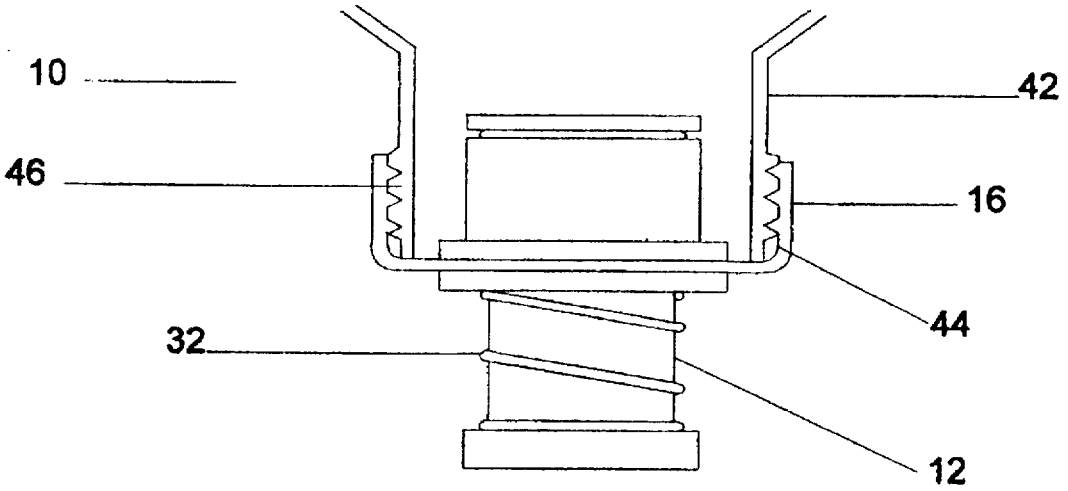
FIG. 3*a* is a side elevational view of a second embodiment of the valve assembly of the present invention in a closed position.
Figure 3B:
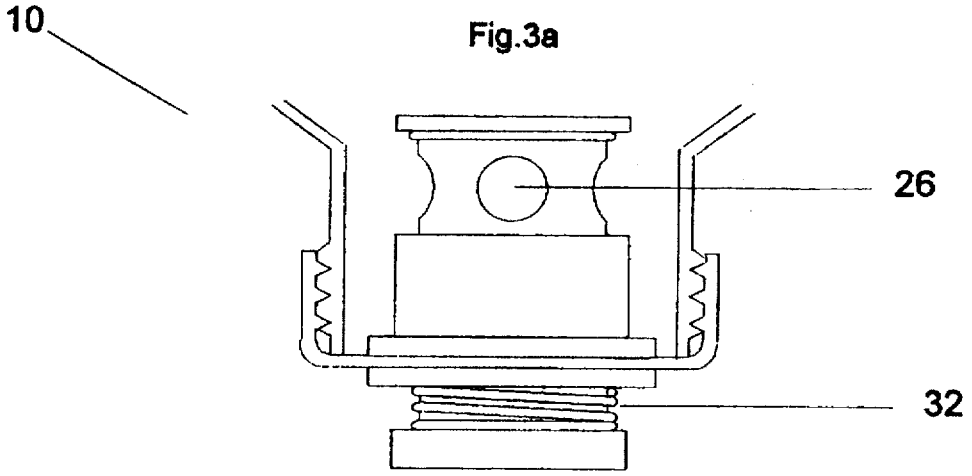
FIG. 3*b* is a side elevational view of the valve assembly of the second embodiment of the present invention in an opened position.
Figure 4:
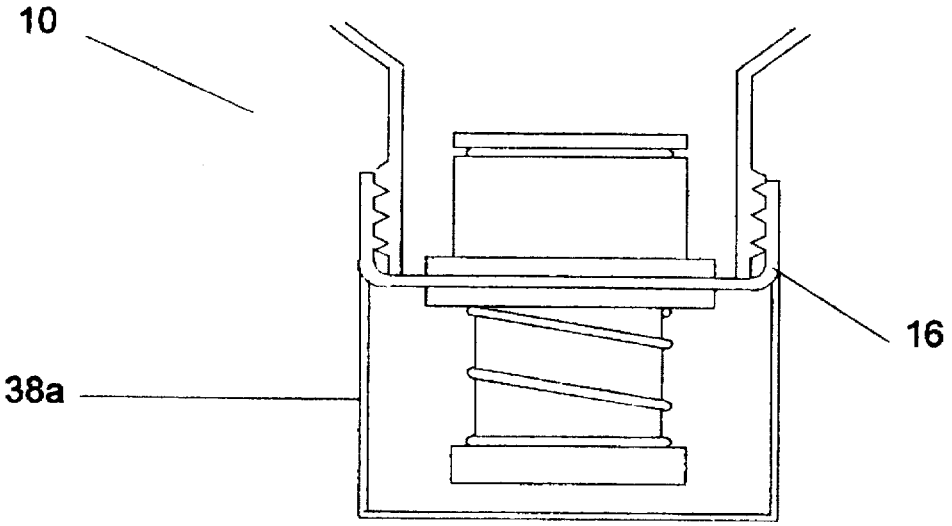
FIG. 4 is a side elevational views of the valve assembly of the second embodiment of the present invention further including a lid.

To accommodate spouts on the bottles or containers 42 that are threaded, the above-described embodiment can be altered to provide for the encompassing side wall of the cap to be interiorly threaded 44. This alteration is illustrated in FIGS. 3*a*–4, a second embodiment of the present invention. This arrangement will enable for the cap 16 of the valve assembly to be adapted to fit onto a bottle wherein the exterior of the spout of the bottle or container 42 is threaded 46.

As illustrated in these figures, the valve assembly 10 is removably secured to a threaded spout of a bottle via the threaded cap. When the valve assembly is in a closed position, the plurality of holes 26 on the shaft 12 are covered by way of the shank 14 (see FIGS. 3*a* and 4). Once pressure is applied to the valve assembly, the spring 32 is biased, forcing the shaft 12 to move linearly to exposed the plurality of holes 26. This provides for the assembly to be in an opened position (see FIG. 3*b*).

The lid 38 illustrated in FIG. 2 can be increased in size as illustrated in FIG. 4. This configuration will permit the lid 38*a* to enclose the entire cap as well as protect the spring from any undesired pressurization.

Figure 5A:
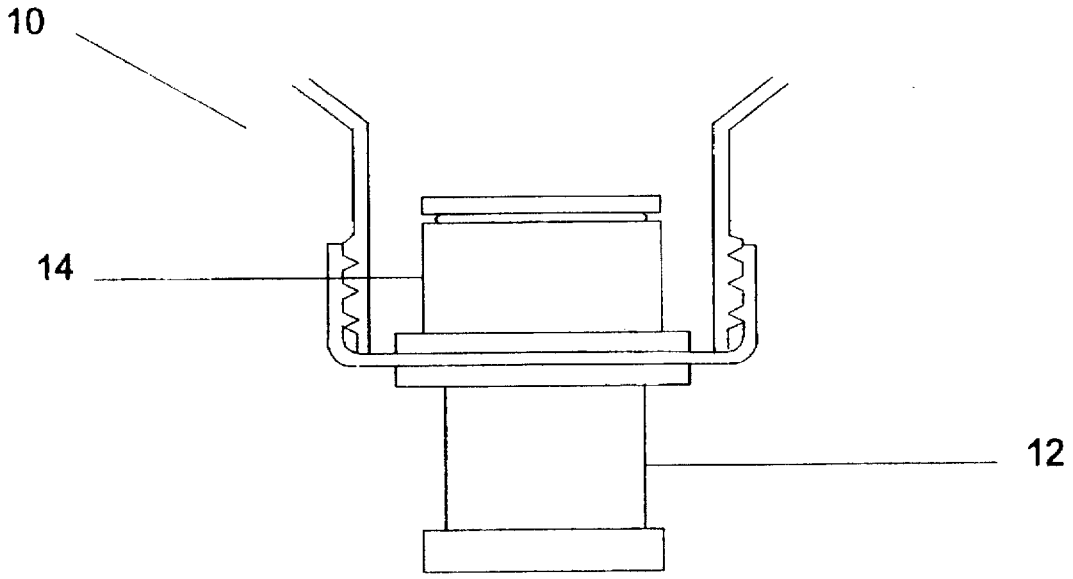
FIG. 5*a* is a side elevational view of a third embodiment of the valve assembly of the present invention in a closed position.
Figure 5B:
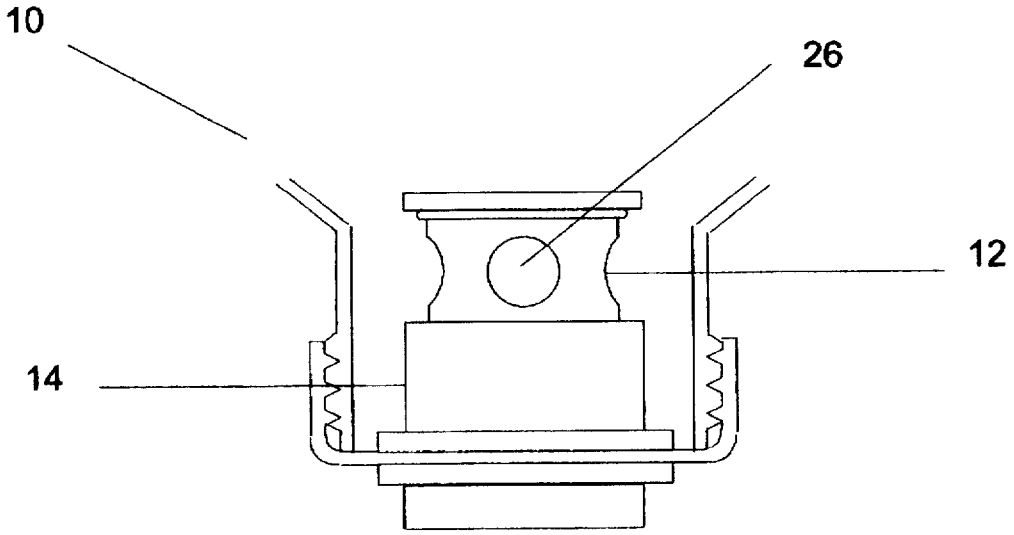
FIG. 5*b* is a side elevational view of the valve assembly of the third embodiment of the present invention in an opened position.

In the above-described embodiments, the shaft is provided with a spring. However, the valve assembly 10 may also be arranged as illustrated in FIGS. 5*a* and 5*b*, such that the shaft 12 does not include a spring. In this configuration, the third embodiment of the present invention, a minimal amount of pressure need to be applied to the shaft 12 in order to permit it to move linearly from a closed position, wherein the shank 14 covers the plurality of holes 26 (see FIG. 5*a*) to an opened position (see FIG. 5*b*).

The valve assembly can also be designed as illustrated in FIGS. 6*a*–7*b*, the fourth embodiment of the present invention. AS seen in these figures, the valve assembly 10 consists of a shaft 12, shank 14, cap 16, and an optional lid 38.

The cap illustrated in these figures is identical in design as the cap illustrated in FIGS. 1*a* and 1*b*. The cap consists of a top and an encompassing side wall. Located on the top of the side wall is an inwardly curved peripheral end portion 18. This end portion and the side wall of the cap provides for a snug, secured, and releasably attachable fit on the spout of a bottle or container (not illustrated).

Though not separately illustrated, this cap in this fourth embodiment can be alter to include an internally threaded encompassing side wall. This will permit for the cap to be releasably secured to a threaded spout of a bottle or container.

Centrally located on the top of the cap is an aperture (not illustrated). This aperture receives the shank 14. The top, encompassing side wall, and inwardly curved peripheral end portion of the cap from an integral object and can be made out of any durable and resilient material, such as rubber or plastic.

Figure 6A:
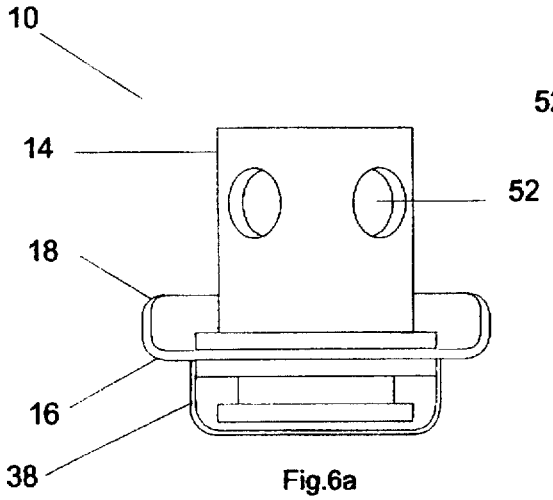
FIG. 6*a* is a side elevational view of a fourth embodiment of the valve assembly of the preen invention in a closed position.
Figure 6B:
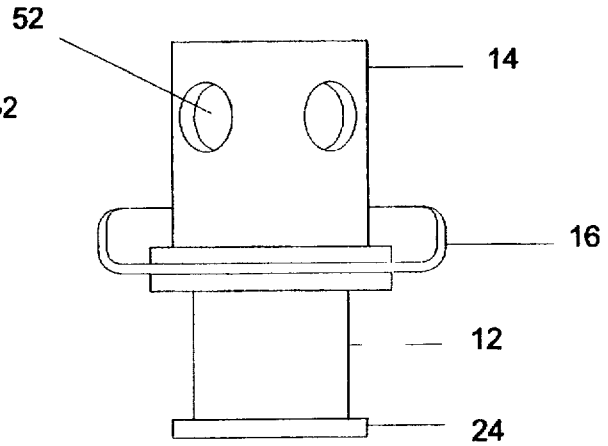
FIG. 6*b* is a side elevational view of the valve assembly of the fourth embodiment of the present invention in an opened position.
Figure 7A:
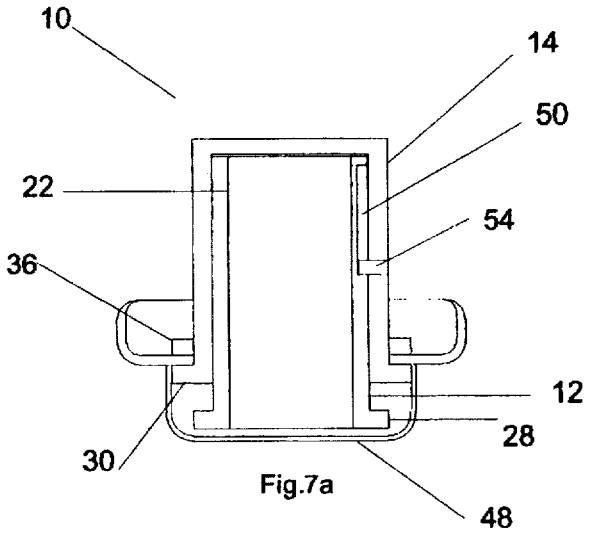
FIG. 7*a* is a cross-sectional view of the fourth embodiment of the valve assembly in a closed position.
Figure 7B:
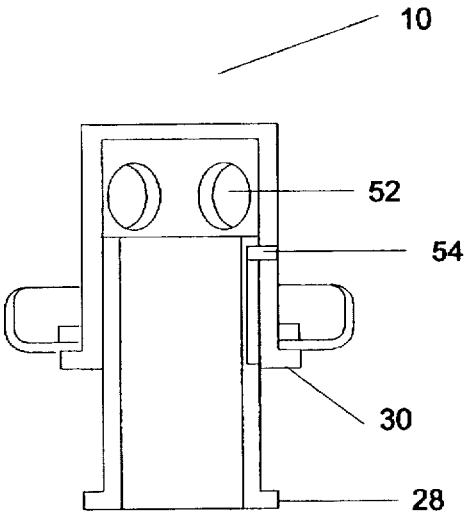
FIG. 7*b* is a cross-sectional view of the valve assembly in an opened position.

The shaft 12 is an elongated cylindrical hollow tube having an enclosed end and an opened end. This shaft 12 further includes a first area 22 and a second area 24. Extending linearly in the first area is a channel 50. This channel 50 aids and guides the valve assembly from a closed position (FIGS. 6*a* and 7*a*) to an opened position (FIGS. 6*b* and 7*b*). Attached to the second area of the shaft is a flange 28. This flange 28 is integral with the shaft.

The shank 14 is a hollow tube which has an enclosed end and an opened end. The shaft is received in the open end of the shank. Extending from the bottom of the shank is a flange 30. Situated near the enclosed end of the shank is a plurality of holes 52. These holes are exposed (opened position) when the shaft is forced downward (see FIGS. 6*b* and 7*b*).

To aid in the linear movement of the shaft, a pin 54 is attached on the shank and extends into the channel of the shaft. The combination of the pin and channel will provide for the shaft to slide freely and in a stable axial movement along the shank, thereby causing the valve assembly to open and close. It is noted that the shank is an integral object and can be fabricated from any durable and sturdy material, such as polyvinyl chloride (PVC).

An O-ring or washer 36 is located on and above the flange 30 of the shank 14 and interiorly on the top of the cap. This O-ring or washer is in direct communication with the interior of the top surface of the cap and will provide an adequate sealing means as well as restrains the flow of fluid from leaking out of the valve assembly.

The optional lid 38 can be located on the valve assembly when the device is not in use. This optional lid will restrict the movement of the shaft and maintain the valve assembly in a closed position.

Utilization of this fourth embodiment occurs when the cap is secured to the bottle or container. Once attached thereto, the user pulls the shaft away from the shank. This will provide for the holes to be exposed or unblocked by the shaft, thereby orienting the valve assembly in an opened position. The movement of the shaft continues until the pin on the shank reaches the end of the channel.

To close or terminate the fluid flow from the container, the shaft is pushed towards the shank. This provides for the shaft to move linearly within the shank. The movement continues until the pin on the shank is at the end of the channel. This provides for the shaft to cover the holes, thereby orienting the valve assembly to be in a closed position.

A fifth embodiment of the present invention permits for the shaft to rotate circumferencially about the shank. This fifth embodiment is illustrated in further detail in FIGS. 8*a*–11*b*. As seen in these figures, the valve assembly 10 consists of a shaft 12, a shank 14, and a cap 16.

The cap illustrated in these figures is identical in design as the cap illustrated in FIGS. 1*a* and 1*b*. The cap consists of a top and an encompassing side wall. Located on the top of the side wall is an inwardly curved peripheral end portion 18. This end portion and the side wall of the cap provides for a snug, secured, and releasably attachable fit on the spout of a bottle or container 42. Though not separately illustrated, this cap in this embodiment can be altered to include an internally threaded encompassing side wall. This will permit for the cap to be releasably secured to a threaded spout of a bottle or container.

Centrally located on the top of the cap is an aperture (not illustrated). This aperture receives the shank 14. The top, encompassing side wall, and inwardly curved peripheral end portion of the cap form an integral object and can be made out of any durable and resilient material such as rubber or plastic.

The shaft 12 is an elongated cylindrical hollow tube having an opened first end and an open second end. This shaft 12 further includes a first area 22 and a second area 24. A first set of holes 56 are located in the first area of the shaft. Attached to and extending from the second area of the shaft is a flange 28. This flange 28 is integral with the shaft. Located between the first set of holes and the first flange is a channel 60. This channel is horizontally situated on the shaft.

The shank 14 is a hollow tube which has an enclosed end and an opened end. The shaft is received in the opened end of the shank. Extending from the opened end of the shank is a flange 30. Located near the enclosed end of the shank is a second set of holes 58. These holes are aligned with the first set of holes of the shaft when the valve assembly is in an opened position (see FIGS. 8*b*, 9*b*, 10*b*). When the first set of holes are not aligned with the second set of holes then the valve assembly is in a closed position (see FIGS. 8*a*, 9*a*, 10*a*).

The shaft can freely rotate within the shank. To aid in the rotational movement of the shaft, a pin 62 is attached to the shank and extends into the channel 60 of the shaft 12. The combination of the pin and channel will provide for the shaft to slide freely and in a stable rotational movement along the shank, thereby causing the valve assembly to open (alignment of the first set of holes with the second set of holes) and close (first set of holes are not aligned with the second set of holes). It is noted that the shank is an integral object and is fabricated from any durable and sturdy material, such as polyvinyl chloride (PVC).

An O-ring or washer 36 is located interiorly on the cap and above the flange of the shank 14. This O-ring or washer contacts the interior of the top surface of the cap and will provide an adequate sealing means as well as restrains the flow of fluid from leaking out of the valve assembly.

Figure 8A:
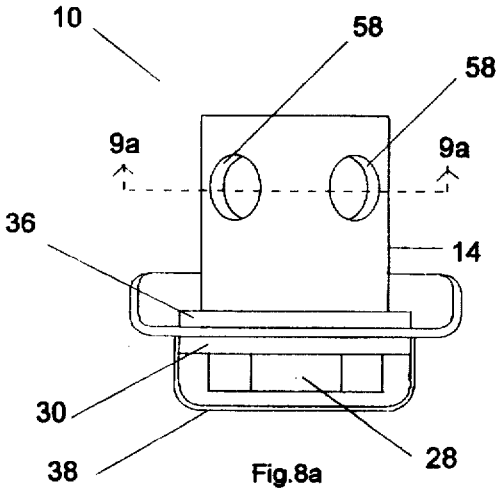
FIG. 8*a* is a side elevational view of a fifth embodiment of the valve assembly of the present invention in a closed position.
Figure 8B:
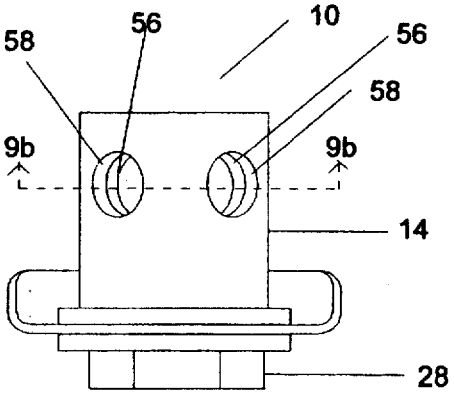
FIG. 8*b* is a side elevational view of the fifth embodiment of the valve assembly of the present invention in an opened position.
Figure 9A:
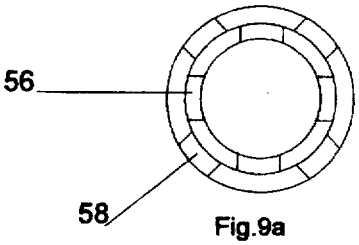
FIG. 9*a* is a detailed cross-sectional view in a closed position of the shaft and shank used in the valve assembly of the present invention and taken along line 9*a*—9*a* of FIG. 8*a*.
Figure 9B:
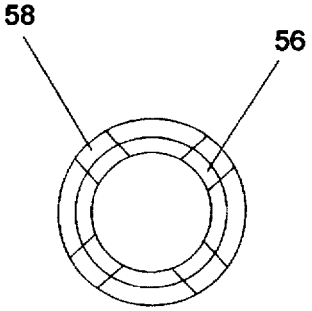
FIG. 9*b* is a detail cross-sectional view in an opened position of the shaft and shank used in the valve assembly of the present invention taken along line 9*b*—9*b* of FIG. 8*b*.
Figure 10A:
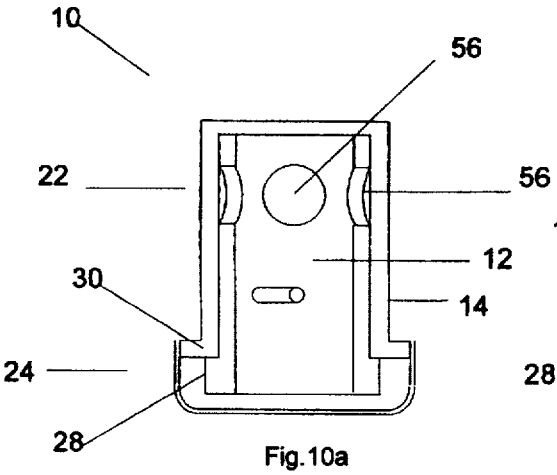
FIG. 10*a* is a cross-sectional view of the fifth embodiment of the valve assembly of the present invention in a closed position.
Figure 10B:
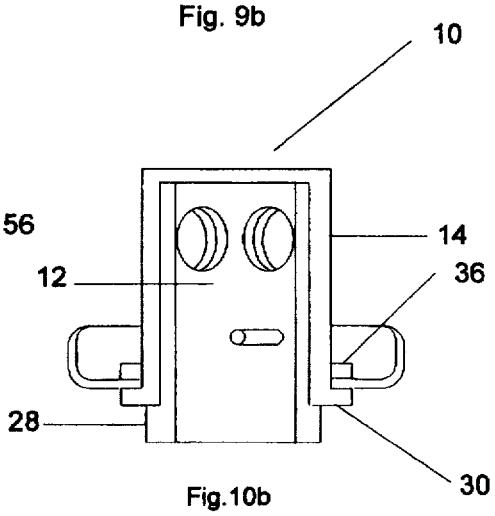
FIG. 10*b* is a cross-sectional view of the fifth embodiment of the valve assembly of the present invention.

A lid 38 may be placed on the valve assembly when it is in a closed position (see FIG. 8*a*). This lid will protect the valve assembly when not in use.

Utilization of this fifth embodiment occurs when the cap is secured to the bottle or container. Once attached, the user rotates the shaft about the shank. Rotation continues until the pin reaches the end of the channel. This will provide for the first set of holes to be aligned with the second set of holes, thereby causing the valve assembly to be in an opened position.

To close or terminate the utilization of the valve assembly, the shaft is rotated in the reverse direction until the pin reaches the opposite end of the channel. This will provide for the first set of holes not to be in alignment with the second set of holes, thereby causing the valve assembly to be in a closed position.

Figure 11A:
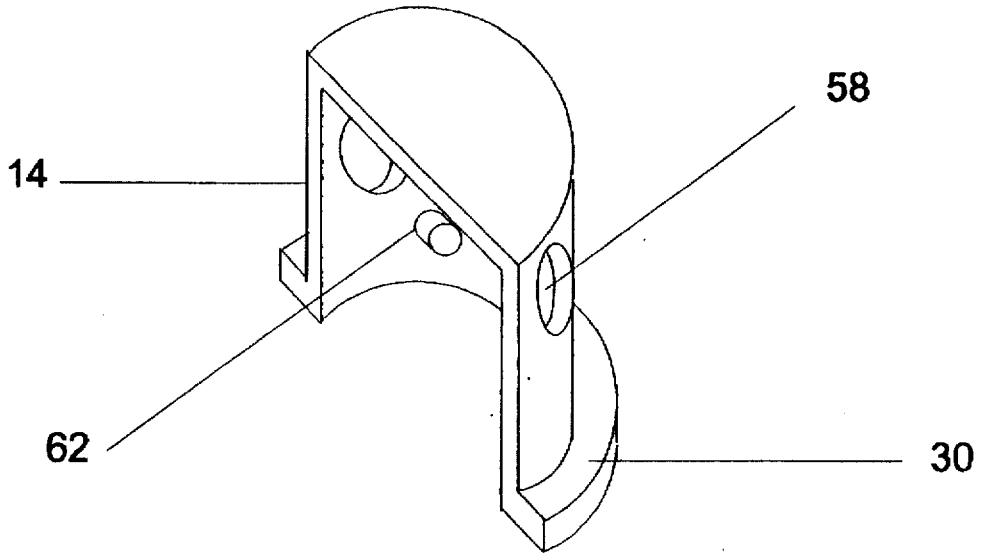
FIG. 11*a* is a partial perspective view of the shank used in the valve assembly of the fifth embodiment of the present invention.
Figure 11B:
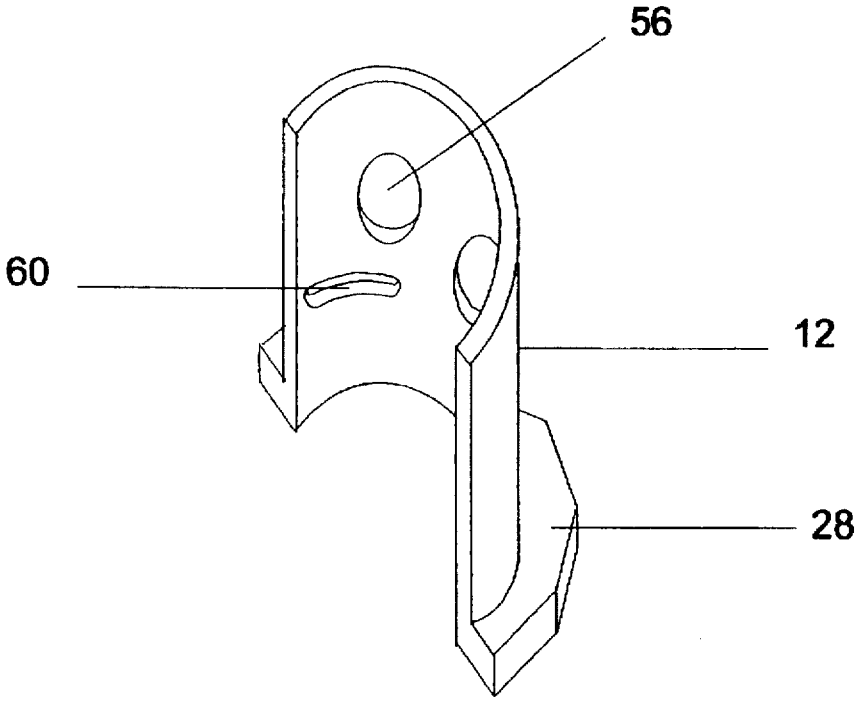
FIG. 11*b* is a partial perspective view to the shaft used in the valve assembly of the fifth embodiment of the present invention.
Figure 12:
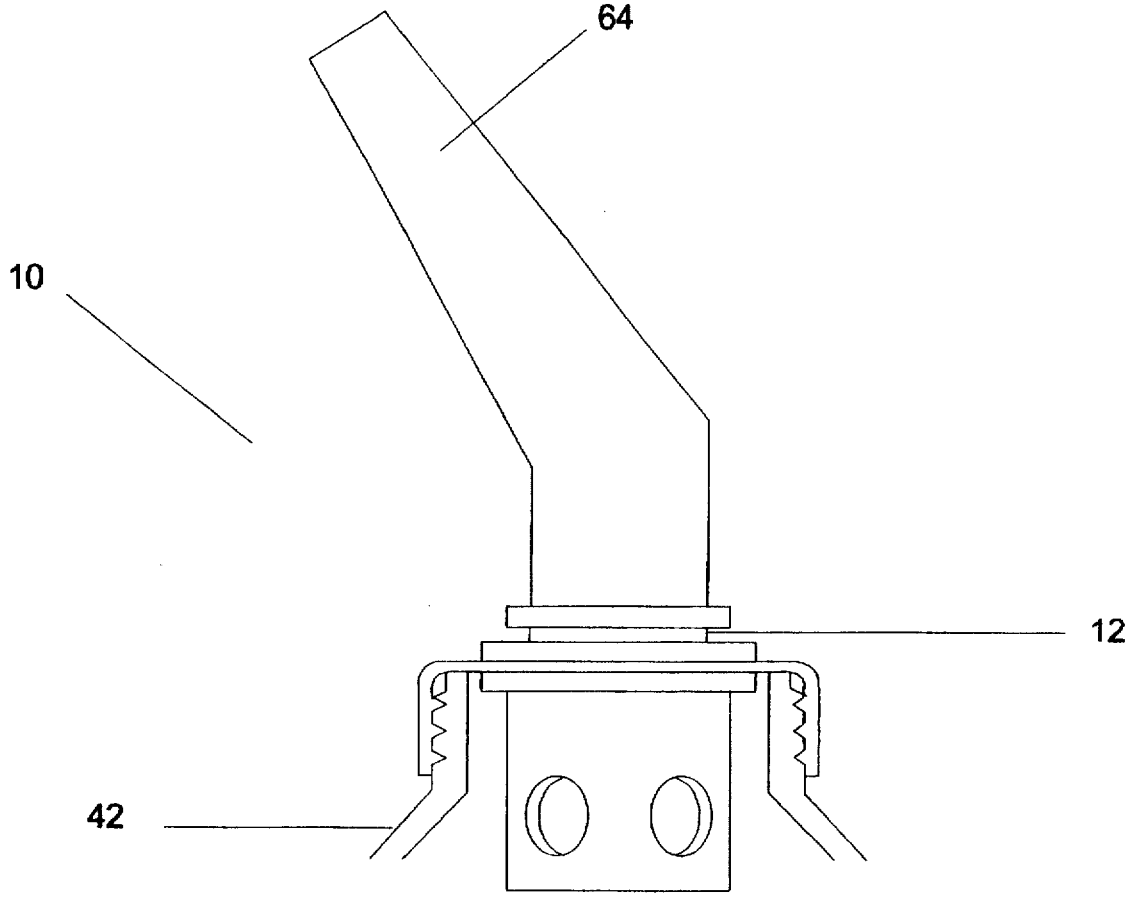
FIG. 12 is a side view of an optional spout which may be attached to the valve assembly of the present invention.

The flanges located on the shaft and shank in any of the above-described embodiment can include a smooth surface (see FIG. 11*a*) or a multi-sided surface (see FIG. 11*b*).

The various embodiments of the present invention can provide for the shaft to include an elongated spout 64. This spout can be permanently attached to the shaft or it can be removably secured to the shaft. The spout, which can be attached to any of the embodiments of the valve assembly, aids in the removal of the fluid from the bottle or container to its desired location. The valve assembly, in combination with the spout, can be utilized in a variety of situations. One situation would be placing the valve assembly onto a bottle of power steering fluid. Inverting the bottle into the opening of the power steering reservoir which is located in the engine of a motor vehicle, and opening the valve assembly. This utilization of the valve assembly permits a user to efficiently and effectively fill the reservoir with virtually no spillage.

Though not separately illustrated the non-reusable seal (illustrated in FIGS. 1*a* and 1*b*) may be incorporated into any of the embodiments illustrated in FIGS. 3*a*–11*b*.

Figure 13A:
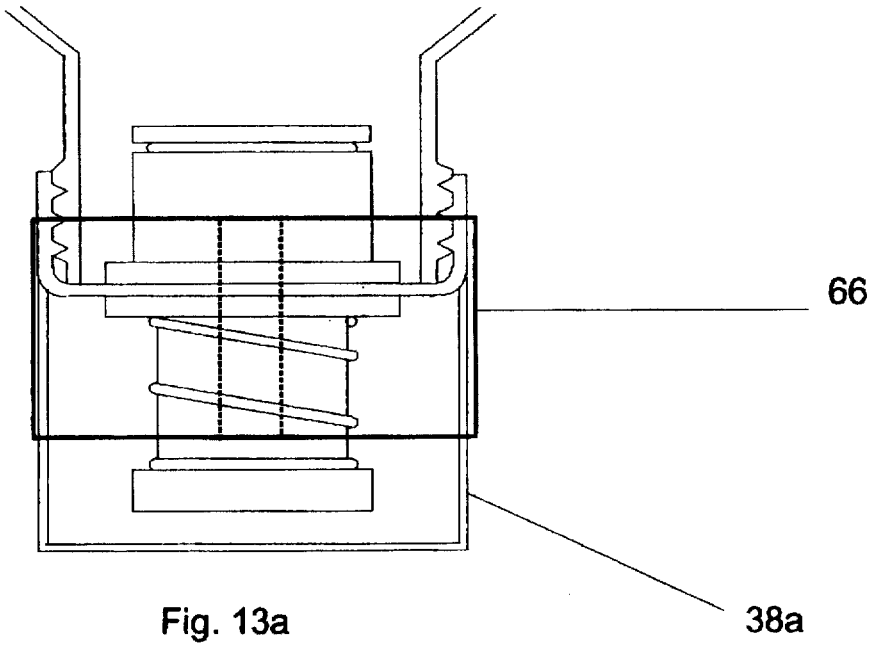
FIG. 13*a* and 13*b* are various view of a seal-like means which can be used with the valve assembly of the present invention.
Figure 13B:
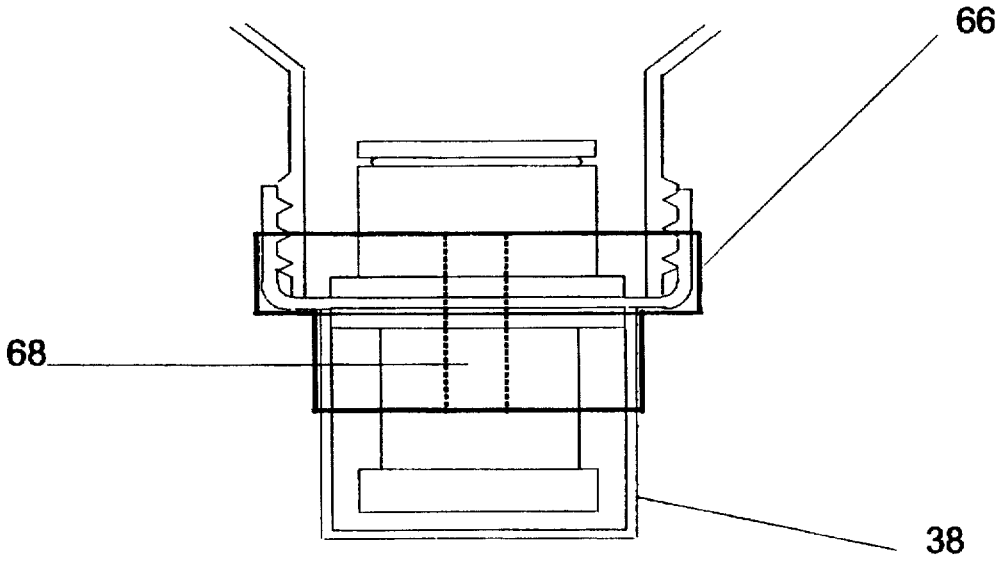

Another sealing means can be utilized with any of the embodiments of the present invention. The sealing means is used to visually indicate whether or not the valve assembly has been tamper with prior to its first use by an individual. These sealing means are illustrated in further detail in FIGS. 13*a*–14*b*. As seen in these figures the cap 16 in any of the embodiments can include a sealing means 66. The sealing means illustrated in FIGS. 13*a* and 13*b* is located on the lid of the valve assembly. This sealing means is shrink wrapped (seal) that is attached onto the lid. This shrink wrap includes a breakable seam 68. This configuration will enable the user to remove the seam 68 and inherently removes the sealing means around the lid so that the valve assembly can be utilized.

Figure 14B:
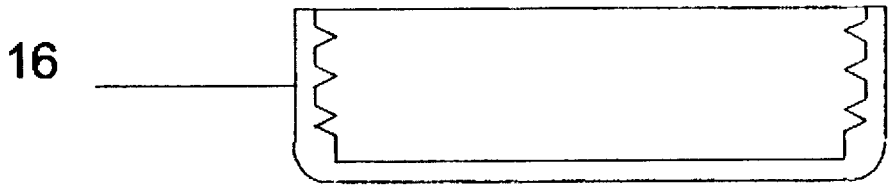
FIG. 14*b* is a side view of a cap of the valve assembly of the present invention after the removal of the seal-like means illustrated in FIG. 14*a*.
Figure 14A:
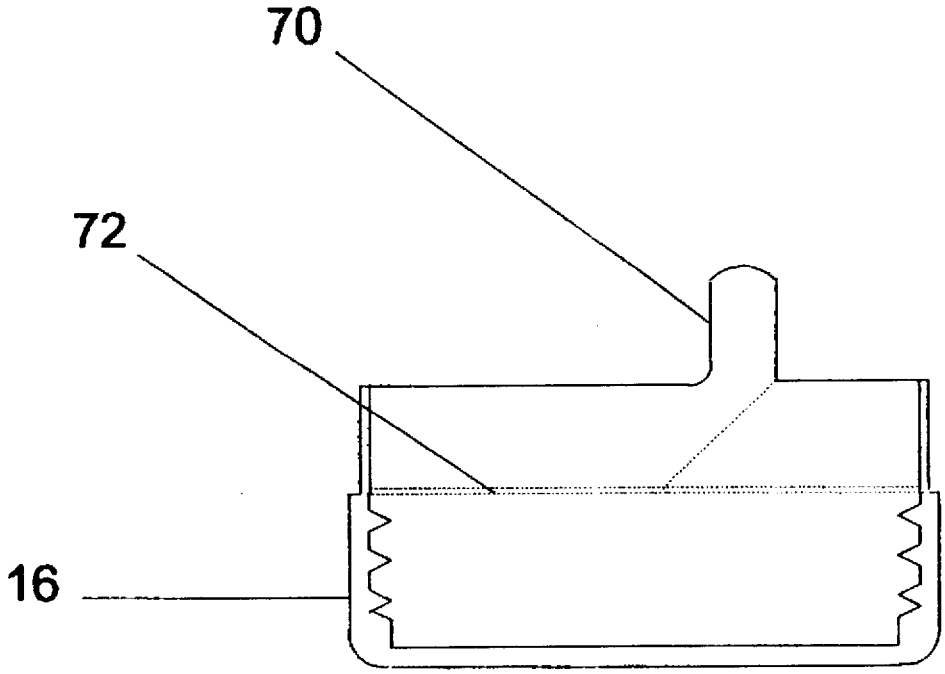
FIG. 14*a* is another embodiment of a seal-like means which can be used with the valve assembly of the present invention.

A second sealing means is illustrated in FIGS. 14*a* and 14*b*. As seen, the sealing means 66 encompasses the cap 16 of the valve assembly. This sealing means is equipped with a tab 70 and a breakable seam 72. This configuration will enable the user to remove the sealing means by pulling on the tab 70 (see FIG. 14*a*). Pulling on the tab provides for the sealing means to be completely removed from the cap (see FIG. 14*b*).

While the invention has been particularly shown and described with reference to an embodiment thereof, it will be understood by those skilled in the art that various changes in form and detail may be made without departing from the spirit and scope of the invention.

We claim:

1. A valve assembly to be used in combination with a bottle or a container comprising:

a cap, a shank, and a shaft;

said cap includes an encompassing sidewall and is adapted to be removably secured to said bottle or said container and said cap further includes an opening;

said shank is received in said opening and said shank is a hollow structure and includes an opened top and an opened bottom;

said shaft is located in said shank for permitting said shaft to move axially within said shank;

said shaft is a hollow structure and includes an opened end, an enclosed end, and at least one hole located between said opened end and said enclosed end;

a first flange is peripherally aligned with said opened end of said shaft and extends perpendicularly from said opened end of said shaft;

said shank includes a second flange peripherally aligned with said opened bottom of said shank and extends perpendicularly from said opened bottom;

a spring is located on said shaft, between said first flange and said second flange; and said spring is biased for terminating downward axial movement of said shaft for providing said valve assembly to be in a closed position by rendering said shank to cover said at least one hole and said spring is unbiased for providing said valve assembly to be in an opened position by rendering said at least one hole to be exposed.

2. A valve assembly as in claim 1 wherein said shaft further includes a third flange and said third flange extends from said enclosed end of said shaft.

3. A valve assembly as in claim 2 wherein a first O-ring or washer is located under said third flange and a second O-ring or washer is located interiorly on said cap and above said second flange.

4. A valve assembly as in claim 1 wherein said cap is threadably secured to said bottle or said container.

5. A valve assembly as in claim 1 wherein a lid is adapted to be removably secured to said second flange.

6. A valve assembly as in claim 5 wherein a removable and non-reusable seal is attached to said opened end of said shaft.

7. A valve assembly as in claim 5 wherein a shrink wrap is secured to said lid and said cap for sealing said lid and said cap; and said shrink wrap includes a breakable seam for permitting said shrink wrap to be removed from said valve assembly.

8. A valve assembly as in claim 5 wherein a sealing means is attached to said lid and said cap;

said sealing means includes a tab and a breakable seam; and said breakable seam is parallel to said encompassing side wall of said cap.

9. A valve assembly as in claim 1 wherein an elongated spout is adapted to be removably secured to said opened end of said shaft.

10. A valve assembly as in claim 1 wherein said first flange includes a multi-sided surface.

* * * * *